US008262196B2

(12) United States Patent
Mitchell et al.

(10) Patent No.: US 8,262,196 B2
(45) Date of Patent: Sep. 11, 2012

(54) METHODS AND APPARATUS TO PROVIDE USER-CUSTOMIZABLE FLUSH PATTERNS IN AN INK-BASED PRINTING SYSTEM

(75) Inventors: Joan L. Mitchell, Longmont, CO (US); Stephen G. Price, Longmont, CO (US)

(73) Assignee: Ricoh Production Print Solutions LLC, Boulder, CO (US)

( * ) Notice: Subject to any disclaimer, the term of this patent is extended or adjusted under 35 U.S.C. 154(b) by 793 days.

(21) Appl. No.: 11/965,464

(22) Filed: Dec. 27, 2007

(65) Prior Publication Data

US 2009/0167813 A1 Jul. 2, 2009

(51) Int. Cl.
*B41J 2/165* (2006.01)

(52) U.S. Cl. ..... 347/35

(58) Field of Classification Search ..... None
See application file for complete search history.

(56) References Cited

U.S. PATENT DOCUMENTS

| | | | | |
|---|---|---|---|---|
| 5,126,752 A | | 6/1992 | Weinberg | |
| 5,659,342 A | * | 8/1997 | Lund et al. | 347/35 |
| 5,903,288 A | | 5/1999 | Yamaguchi | |
| 6,116,715 A | | 9/2000 | Lefebvre et al. | |
| 6,859,218 B1 | * | 2/2005 | Luman et al. | 347/139 |
| 2004/0085391 A1 | | 5/2004 | Kanaya et al. | |
| 2004/0189737 A1 | | 9/2004 | Nakashima | |
| 2006/0214979 A1 | * | 9/2006 | Inoue | 347/22 |
| 2006/0290739 A1 | | 12/2006 | Hatayama | |
| 2007/0057983 A1 | * | 3/2007 | Kawaguchi et al. | 347/9 |

FOREIGN PATENT DOCUMENTS

JP 2003127429 5/2003

* cited by examiner

*Primary Examiner* — Matthew Luu
*Assistant Examiner* — Alejandro Valencia
(74) *Attorney, Agent, or Firm* — Duft Bornsen & Fishman, LLP

(57) ABSTRACT

Methods and apparatus for user customization of flush patterns in an ink-based printing system. Features and aspects hereof provide for user input to define a flush pattern and to define a location at which the flush pattern is to be placed on sheetside images. By integrating the flush pattern as defined by the user into the sheetside images, the flush pattern may convey useful information or may at least be aesthetically acceptable as compared to prior flush pattern definitions. The user may select among a plurality of standard, pre-defined patterns and locations or may define a fully customized pattern to be placed at a fully customized location. Text or other potentially useful patterns may be defined by the user. Analysis of the sheetside images may permit the user to define placement of the pattern so as to avoid occluding information imprinted on the sheetside images.

19 Claims, 8 Drawing Sheets

METHODS AND APPARATUS TO PROVIDE USER-CUSTOMIZABLE FLUSH PATTERNS IN AN INK-BASED PRINTING SYSTEM

BACKGROUND

1. Field of the Invention

The invention relates generally to methods and apparatus in a printing system to integrate ink flush patterns with imprinted data in an ink-based printing system. More specifically, the invention relates to methods and apparatus for allowing user customization of the style and placement of flush patterns to allow useful integration of the flush patterns with the images on a printed page.

2. Discussion of Related Art

In ink-based printing systems (e.g., inkjet and other ink deposition systems) it is often necessary to clean clogged ink deposition nozzles. As the printing system is producing imprinted images on paper (or other printable media), the frequency and volume of ink usage for each of multiple ink colors may vary. Some ink nozzles for some ink colors may be heavily used over a sequence of printed sheets/images while other nozzles associated with other ink colors may be infrequently used or not used at all. These nozzles with limited use may clog if not maintained by a cleaning procedure.

It is generally known to stop the printing process to permit manual intervention to clear all nozzles of an ink-based printing system. The manual intervention may entail purely manual procedures such as actuating a cleaning request option on the operator panel of the printing system. Or, such manual procedures may entail formatting and printing a page/image that intentionally utilizes all ink nozzles or selected ink nozzles to keep the nozzles clean (by flowing a sufficient volume of ink there through). Such manual intervention gives rise to a need for human intervention to clean the nozzles if not also to format a suitable cleaning page/image and to forward the formatted image to the marking engine of the printing system. This manual intervention can cause a significant delay in the continued processing of the printing system. In high-volume production printing systems, such a delay can be very costly.

To avoid the delays inherent in human intervention, it is generally known to provide some automated procedure to flush nozzles of an ink-based printing system without requiring manual intervention and thus without stopping the operation of the printing system to await human intervention. In some known automated techniques, flush lines (e.g., a pattern of pixels typically formatted as lines of varying colors of ink) are added to an imprinted image printed by the printing in its production printing process. Flush lines are most generally rendered graphical images/pixels intended merely to cause ink to flow through all (or selected ones) of the nozzles of the ink-based printer. This flow of ink helps avoid clogging of the nozzles. The graphical image so produced by flush lines as presently practiced is not intended to represent any information meaningful to a user. In prior techniques, such flush lines are placed on the printable medium (e.g., paper) in an area that may be cut away (e.g., "chipped out").

However, in a large number of printing applications there may be no area of the printable medium that is discarded (e.g., edge to edge printing on the printable medium). Thus a flush of the various ink nozzles either requires the above identified manual intervention or requires that the flush lines be integrated with the printed pages and thus may appear on one or more printed pages potentially occluding data on the printed page. Since the flush pattern may be integrated on the sheetside images, some printing systems allow a simple, pre-defined flush pattern—a line—to be adjusted for placement on the sheetside and for thickness of the flush line to be rendered. However, the flush line still provides no useful purpose on the imprinted sheetside image other than the useful purpose of flushing ink.

It is evident from the above discussion that an ongoing need exists for improved methods and apparatus for performing automated flush procedures for ink-based printing systems where the flush pattern must be integrated with the printed images.

SUMMARY

The present invention solves the above and other problems, thereby advancing the state of the useful arts, by providing methods and apparatus for allowing user customization of the patterns used for flush patterns integrated with the printed images and user customization for placement of the selected flush patterns on the printed pages. In particular, the flush patterns may provide informational content and thus provide a useful purpose on the imprinted sheetsides other than the useful purpose of flushing ink.

One aspect hereof provides a method for managing ink flush operations in an ink-based printing system. The method includes receiving user input to define a flush pattern to be applied to printed pages generated by the printing system. The method also includes receiving user input to define a location for placement of the flush pattern on a printed page. Responsive to the user input, the method includes adding the defined flush pattern to a sheetside image at the defined location on the sheetside image, and imprinting the sheetside image on a printable medium to thereby flush ink in the printing system by imprinting the selected flush pattern.

Another aspect hereof provides a method for flushing ink in an ink-based printing system. The method includes determining a flush pattern to be applied to a plurality of sheetside images in a sequence of printed pages and determining a page location at which the flush pattern will be applied to the plurality of sheetside images. The method then applies the flush pattern to the plurality of sheetside images and imprints the sequence of printed pages onto printable media with applied flush patterns to flush ink through one or more ink nozzles of the ink-based printing system. The flush pattern and the page location of the flush pattern are determined so as to avoid occluding information on each of the plurality of sheetside images.

Still another aspect hereof provides apparatus for flush pattern processing in an ink-based printing system. The apparatus includes a marking engine for imprinting sheetside images as ink on a printable medium and a printer controller coupled to the marking engine and adapted to generate sheetside images to represent a print job received from an attached source of print jobs. The printer controller is further adapted to apply each sheetside image to the marking engine for imprinting. A flush pattern generator is also provided and coupled to the printer controller. The flush pattern generator is adapted to modify a sheetside image generated by the printer controller to add a flush pattern thereto prior to applying the sheetside image to the marking engine. The apparatus also includes a user interface module coupled to the flush pattern generator adapted to define the flush pattern to be added to the sheetside

DETAILED DESCRIPTION OF THE DRAWINGS

FIGS. 1 through 8 and the following description depict specific exemplary embodiments of the present invention to teach those skilled in the art how to make and use the invention. For the purpose of this teaching, some conventional aspects of the invention have been simplified or omitted. Those skilled in the art will appreciate variations from these embodiments that fall within the scope of the present invention. Those skilled in the art will appreciate that the features described below can be combined in various ways to form multiple variations of the present invention. As a result, the invention is not limited to the specific embodiments described below, but only by the claims and their equivalents.

Figure 1:
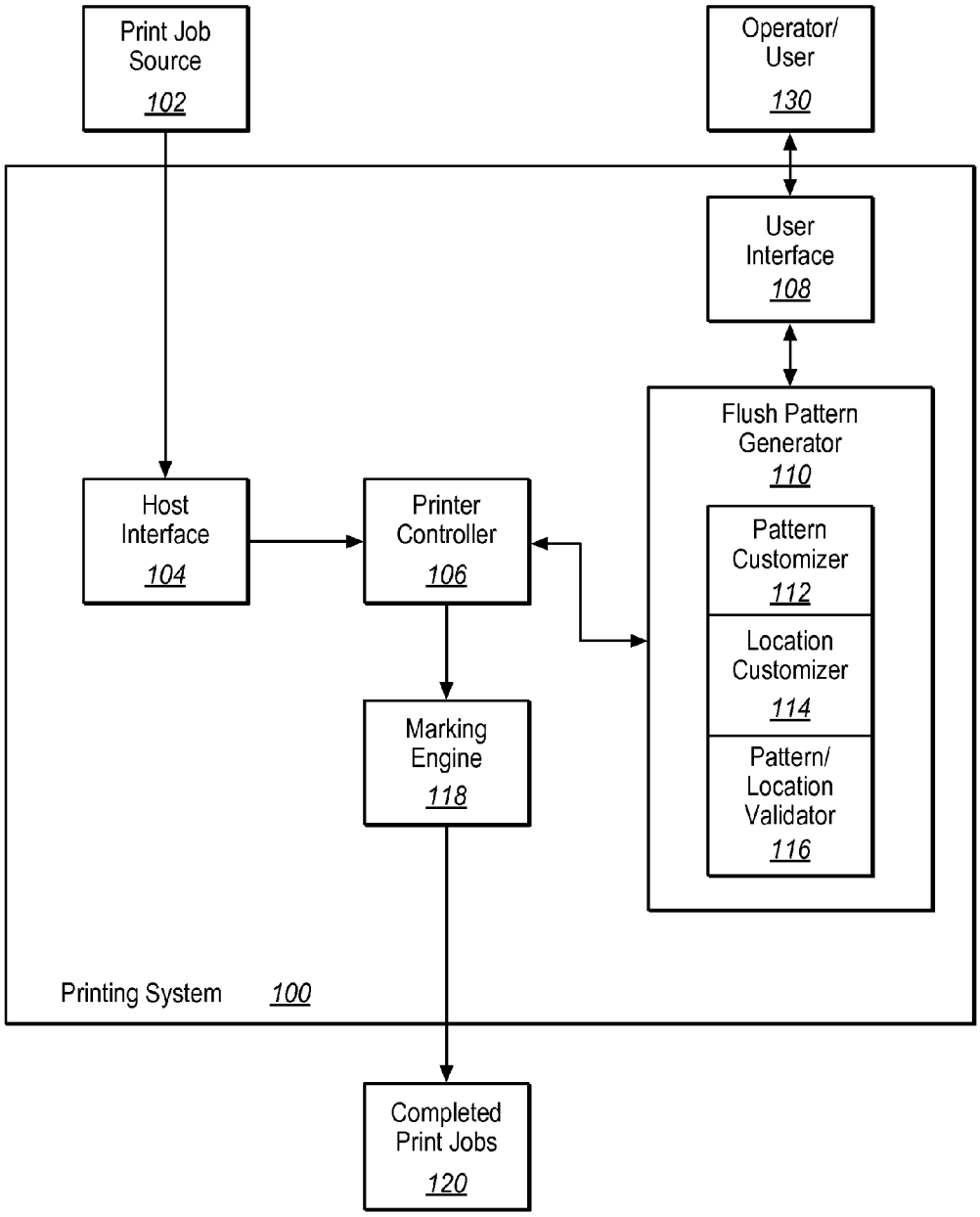
FIG. 1 is a block diagram of an exemplary printing system adapted to enable user customization of flush patterns and placement on printed pages in accordance with features and aspects hereof

FIG. 1 is a block diagram of a printing system 100 enhanced in accordance with features and aspects hereof to allow user definition of an informative flush pattern to be applied to sheetside images and to allow user definition of the location of such a flush pattern to be added to the sheetside images. Printing system 100 includes printer controller 106 to control overall operation of the printing system including rasterizing or ripping print jobs received from print job source 102 through host interface 104. A rasterized or ripped print job generally comprises a sequence of printed pages distributed over a number of sheetside images. The sheetside images are then applied to marking engine 118 for imprinting using ink-based printing techniques such as so-called ink jet marking techniques in which individual droplets of ink of a plurality of colors are deposited on a printable medium on a pixel by pixel basis. The print jobs so imprinted are represented as completed print jobs 120 exiting from the marking engine 118.

In accordance with features and aspects hereof, printer controller 106 is coupled to flush pattern generator 110 for generating or defining an informative flush pattern to be added to sheetside images generated by printer controller 106. In addition, flush pattern generator 110 is adapted to define the position or location for a selected flush pattern for its integration with a sheetside image. In general, the informative flush pattern and the location of such a flush pattern to be added to a sheetside image is defined by user interaction with an operator or user 130 through user interface 108 coupled to flush pattern generator 110. Flush pattern generator 110 may provide a plurality of standard, pre-defined flush patterns and standard, pre-defined locations for such flush patterns. The user interface 108 then receives user input identifying which of the predefined patterns and pre-defined locations are desired by the user for integration with sheetside images generated by printer controller 106. The selected pattern is then provided to printer controller 106 for integration with one or more generated sheetside images.

In addition to standard, pre-defined patterns and locations, flush pattern generator 110 may also include a pattern customizer element 112 and a location customizer element 114. Pattern customizer 112 interacts with user 130 through user interface 108 to permit a user to define a customized flush pattern to be used. Location customizer 114 similarly interacts with user 130 through user interface 108 to define a customized location for placement of a flush pattern on a sheetside image.

As noted above, by permitting flexible selection or definition of a flush pattern and flexible selection or definition of the location for placement of a flush pattern on a sheetside image, the flush pattern may be integrated with information imprinted on the sheetside image in such a manner as to be useful. Examples of useful information may include text messages, logos, advertisements, images, bar-coded information, etc.—essentially anything conveying information to a user as it also flushes ink rather than only serving the purpose of flushing ink such as by simple lines or random patterns. By comparison, prior techniques generated useless flush patterns serving only the practical purpose of flushing ink nozzles in the marking engine. Such useless patterns were not provided or utilized in any manner to allow useful integration with the information imprinted on a sheetside image. For example, a flushing pattern may be added to the sheetside image in an area of the sheetside image known to include a dark border or other dark, opaque image or graphic information. Or, for example, a flushing pattern may be added to an edge of a sheetside image (e.g., top, bottom, left, or right edges) where the sheetside image is known to generally remain blank or empty. Further, the selected pattern (whether predefined or customized by the user) may represent a useful pattern. For example, sequences of textual characters providing some standard message or corporate identity may include multiple colors and may be used as a flush pattern. Or, for example, a background bar of appropriate colors to achieve desired flushing may be added to the sheetside image and a textual message overlaid on the background bar image. A wide variety of such flush patterns may be predefined or customized by a user and added to one or more sheetside images in a suitable location as selected or defined by the user.

Those of ordinary skill in the art will recognize that certain patterns or locations will be useful for some printing system and not for others. For example, in the case of a fixed head printing system, the printable media generally passes under the fixed head from top edge of the sheetside toward bottom edge of the sheetside. In such a system a pattern printed at the left or right edges of the printable medium will only flush relatively few nozzles in the array of nozzles. Thus patterns at the left and right edge are generally not useful in such fixed head printing systems. By contrast, with moving head printing systems, the head moves from side to side (left edge to right edge and right edge to left edge). In such moving head systems, a pattern at any of the four edges of the sheetside may be used to provide adequate volume of ink flushing.

Figure 8:
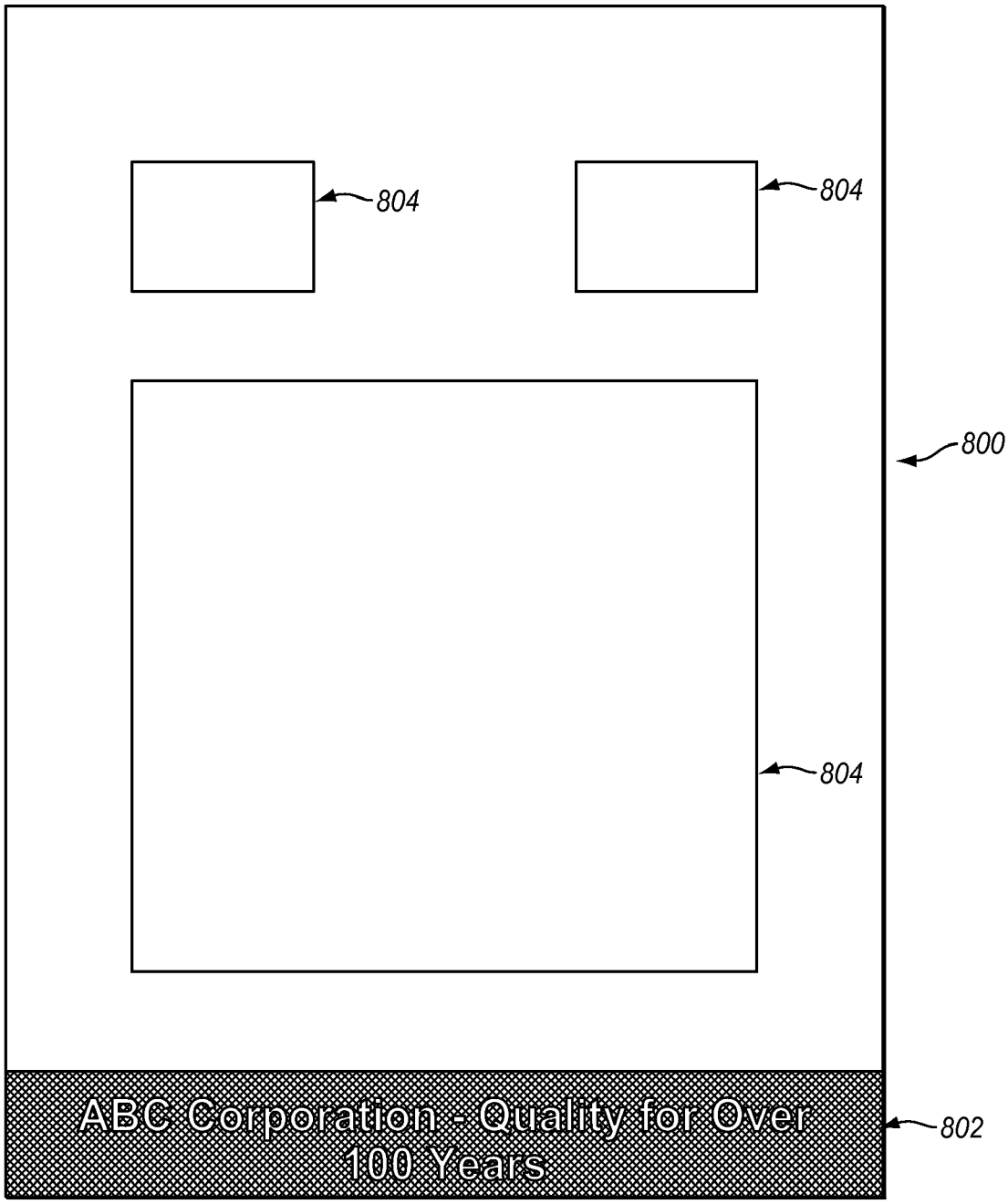
FIG. 8 is a diagram of an exemplary sheetside image incorporating a user customizable flush pattern in the image in accordance with features and aspects hereof.

FIG. 8 shows one exemplary sheet image 800 modified in accordance with features and aspects hereof to add a customized flush pattern 802 at the bottom edge of sheetside image 800. Analysis of sheetside image 800 may reveal that relevant information 804 appears in various locations on the sheetside image but also reveals that the edges of the sheetside image 800 are blank (devoid of relevant information) and thus available for locating a user defined/selected flush pattern 802. As shown in FIG. 8, customized flush pattern 802 may include a background bar with overlaid text. The overlaid text may be customized by a user to provide useful information. The background bar may provide the desired flushing of ink from each of the nozzles determined to require flushing for this sheetside image. Thus a user selected or customized flush pattern may often be positioned around the perimeter or edges of the sheetside image. In addition, location customizer 114 of FIG. 1 may interact with a user to further analyze contents of a sheetside image or of the plurality of sheetside images in a sequence of printed pages to identify other possible locations for placement of a user selected or user customized flush pattern.

Figure 2:
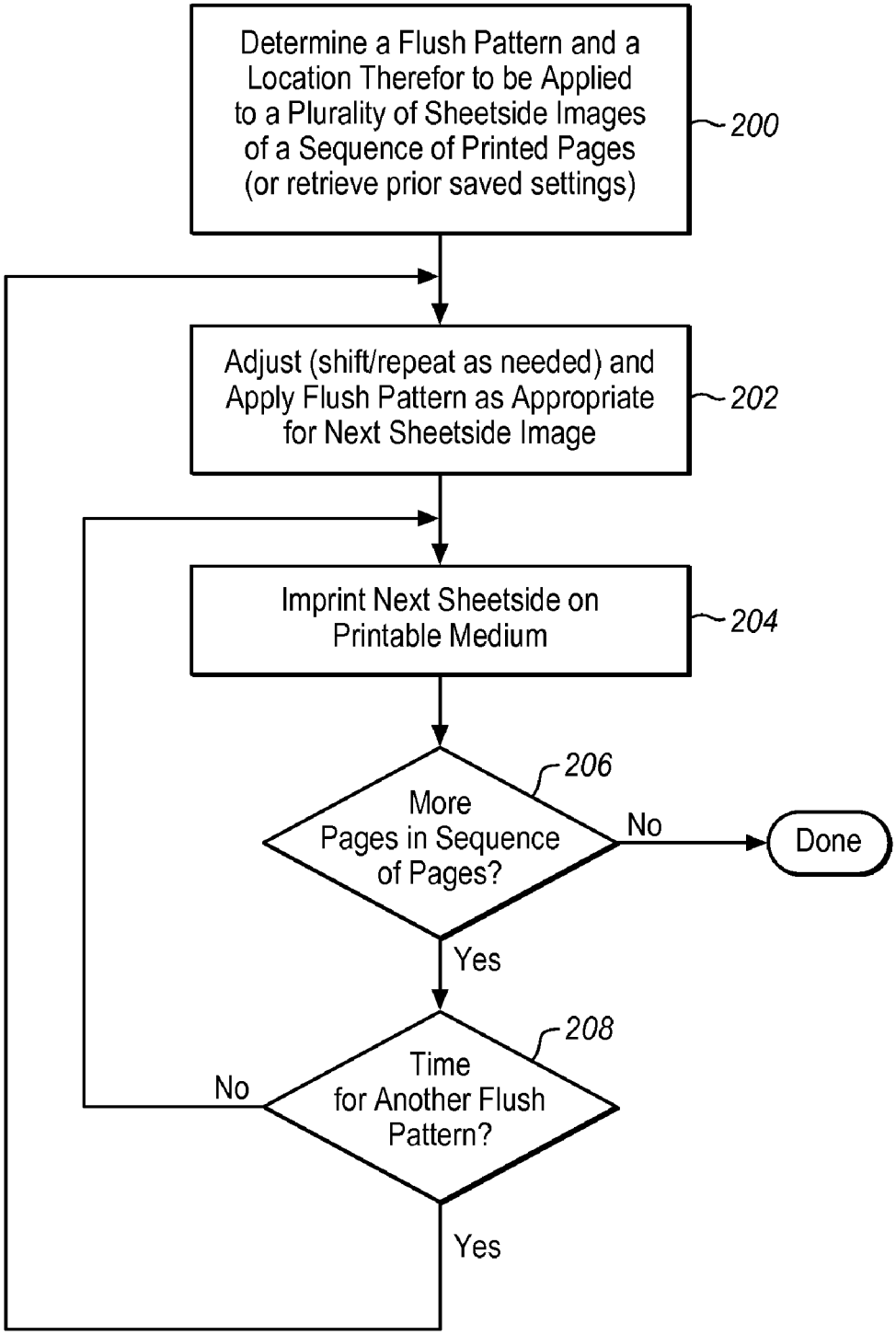
FIG. 2 is a flowchart describing an exemplary method in accordance with features and aspects hereof to provide user customized flush patterns on ink-based printing systems.

FIG. 2 is a flowchart describing an exemplary method in accordance with features and aspects hereof to provide a user customized flush pattern on a plurality of sheetside images in a sequence of printed pages. Step 200 interacts with the user to determine or define a flush pattern and a location on the sheetside images at which the selected flush pattern should be placed. As noted above, the selection of a flush pattern and a location may comprise selection from a plurality of standard, pre-defined options. For example, standardized flush patterns represented as various horizontal and/or vertical lines of sufficient height and width to provide a desired volume of ink flushing may be defined as standardized, pre-defined flush patterns from which a user may select. In like manner, various standard, pre-defined locations such as parallel to each of the four edges of a sheetside image may be provided as standardized, pre-defined locations for adding the selected flush pattern to a sheetside image. Still further, the determination or definition of a flush pattern and its location may be more fully customized such that a user may provide his or her own desired pattern and a desired location anywhere within the sheetside image. For example, user provided text using various colors of ink may be utilized as a flush pattern. Or, for example, text applied to a solid background bar as described above may be provided by a user. Detailed analysis of one or more sheetside images of a sequence a printed pages may also be performed to identify other potential locations in addition to the standard, pre-defined locations around the edges of a sheetside image. Still further, a flush pattern and location may be determined by retrieving setting previously defined for similar types of print jobs. A user's previous definition may be saved in a memory associated with the printing system and may be retrieved by a user when a similar print job is encountered. Thus step 200 may also entail user interaction to identify and retrieve a previous definition of a flush pattern and a location therefore.

Having so determined, selected, or defined a flush pattern and the location for placement of the flush pattern, steps 202 through 208 are iteratively performed to imprint each sheetside of a sequence of printed pages with an appropriate addition of the selected or defined flush pattern placed in the identified location. Step 202 first adjusts the selected or defined flush pattern as appropriate for application to the next sheetside image. For example, a user may customize a flush pattern by defining not only the content of a pattern but also a sequence of shifting such that the pattern may be shifted or rotated each time it is applied to a next sheetside image. Such shifting or rotation of the flush pattern may aid in providing desired volume of flushing over a sequence of pages. For example, where flushing is performed after some number of printed sheetside images rather than on each printed sheetside image (e.g., after some predetermined volume of printable media has been imprinted), a flush pattern may be modified by rotation or shifting of the pattern prior to each use to help assure an appropriate volume of flushing occurs at each sheetside where the flush pattern is applied. By contrast, where flushing occurs on each sheetside image, the need for such modification, shifting, or rotation of the flush pattern is largely diminished to assure appropriate volume of ink flushing.

Following application of the adjusted flush pattern to the present sheetside image, step 204 imprints the sheetside image as modified with the flush pattern by transferring the sheetside image to a marking engine. If the sheetside image includes the desired flush pattern, an appropriate volume of ink will be flushed by the marking engine when imprinting this sheetside image. Step 206 then determines whether more pages remain in the sequence of pages to be imprinted. If not, the method completes. Otherwise, step 208 determines whether the next sheetside image to be processed will also require the addition of a flush pattern. As noted above, a flush pattern may be added to each sheetside image imprinted or may be added periodically as a sufficient number of pages or sheetside images have been imprinted. For example, the printer controller may monitor the number of feet of continuous form paper fed through the marking engine and may add the flush pattern at the designated location only after a sufficient volume of paper has been processed through the marking engine. The frequency of inclusion of the flush pattern on imprinted images is a matter of design choice to be determined for each application of features and aspects hereof and/or in accordance with usage specifications of the marking engine. Those of ordinary skill and the art will readily recognize parameters involved in such design choices.

If step 208 determines that another flush pattern should be generated now, processing continues looping back to step 202 to again adjust the flush pattern as required for a next sheetside image and to apply the adjusted flush pattern in the selected location on the next sheetside image. If step 208 determines that another flush pattern is not yet required, processing continues looping back to step 204 to simply imprint the next sheetside image on the printable medium in the marking engine.

Figure 3:
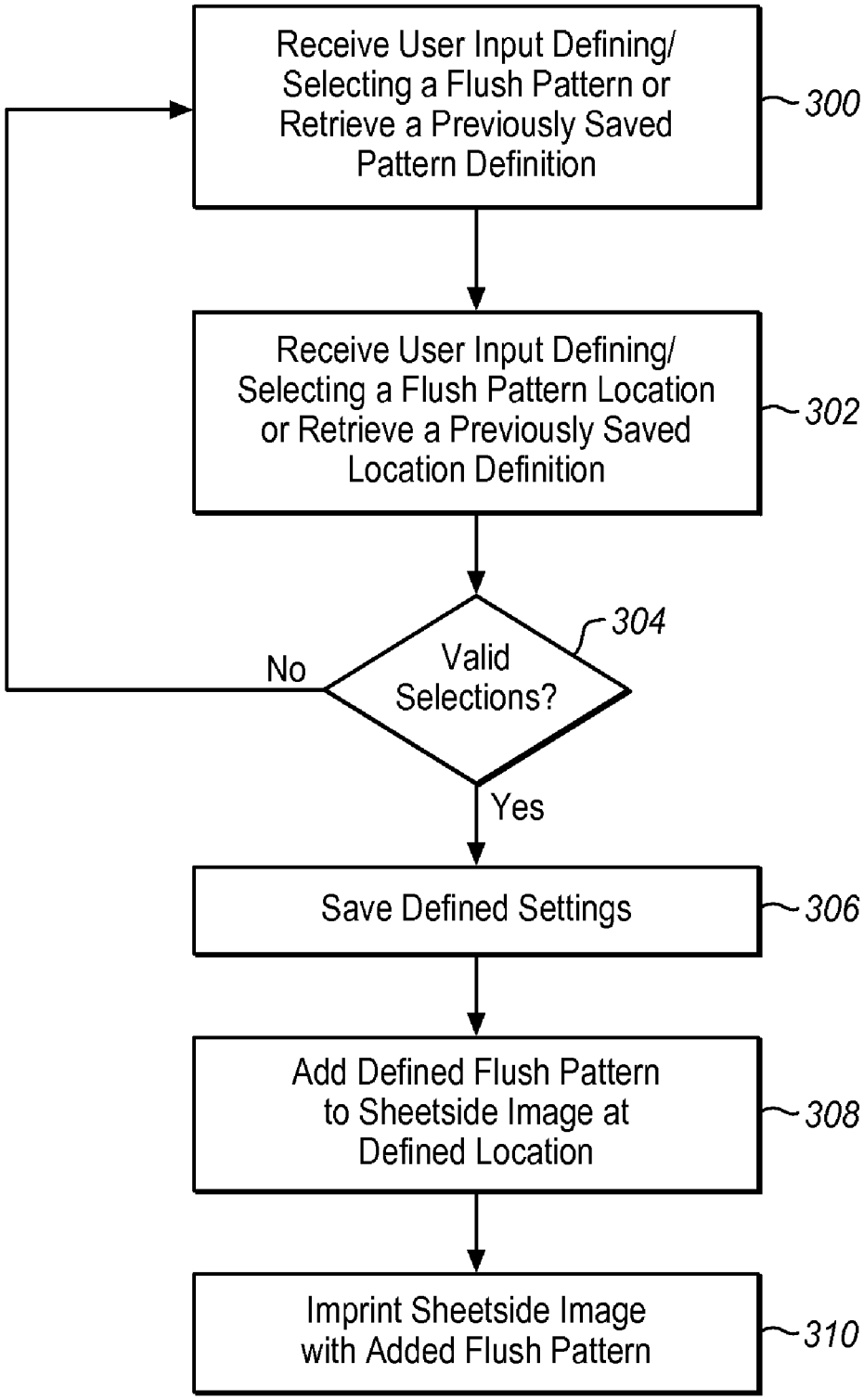
FIG. 3 is a flowchart describing another exemplary method in accordance with features and aspects hereof to provide user customized flush patterns on ink-based printing systems.

FIG. 3 is a flowchart describing another exemplary method in accordance with features and aspects hereof to allow a user to define or select flush patterns to be applied to imprinted pages and also to define or select a location for the desired flush pattern on the sheetside image to be imprinted. Step 300 first receives user input defining or selecting a desired flush pattern. Alternatively, step 300 may retrieve a flush pattern previously defined and saved. As noted above, one such input may permit a user to select among one or more standardized, pre-defined flush patterns or may permit the user to enter information defining a fully customized pattern. Step 302 next receives user input to define or select a desired location for the identified flush pattern on the sheetside image. Alternatively, step 302 may retrieve a location previously defined and saved. As above, such user input may entail allowing the user to select from one or more standardized, pre-defined locations (e.g., each edge of a sheetside image) or may allow the user to define a fully customized location for the selected flush pattern to be applied. Step 304 next validates the user's selections to assure that the selected flush pattern when placed at the selected location does not overlay or occlude information content of the associated sheetside image. Such validation may include analyzing one or more sheetside images to identify appropriate locations and to verify that the selected flush pattern when positioned at the selected location does not inappropriately interfere with the content of the sheetside image. If step 304 determines that the user's selections are not valid, processing continues looping back to step 300 to receive further user input until a valid selection is made. When a valid selection is presented, step 306 saves the flush pattern and location so defined for re-use in later print jobs. Step 308 adds the defined or selected flush pattern to the current sheetside image at the defined or selected location. Step 310 imprints the sheetside image with the added flush pattern at the selected location. Any number of such sheetside images may be generated by repetition of the method of FIG. 3. Further, as noted above, the flush pattern may be included on each sheetside image or may be provided only periodically based on the volume of printing performed by the marking engine. Thus, the method of FIG. 3 may be applied for each sheetside or steps 300 through 308 may be excluded for certain sheetside images.

Figure 4:
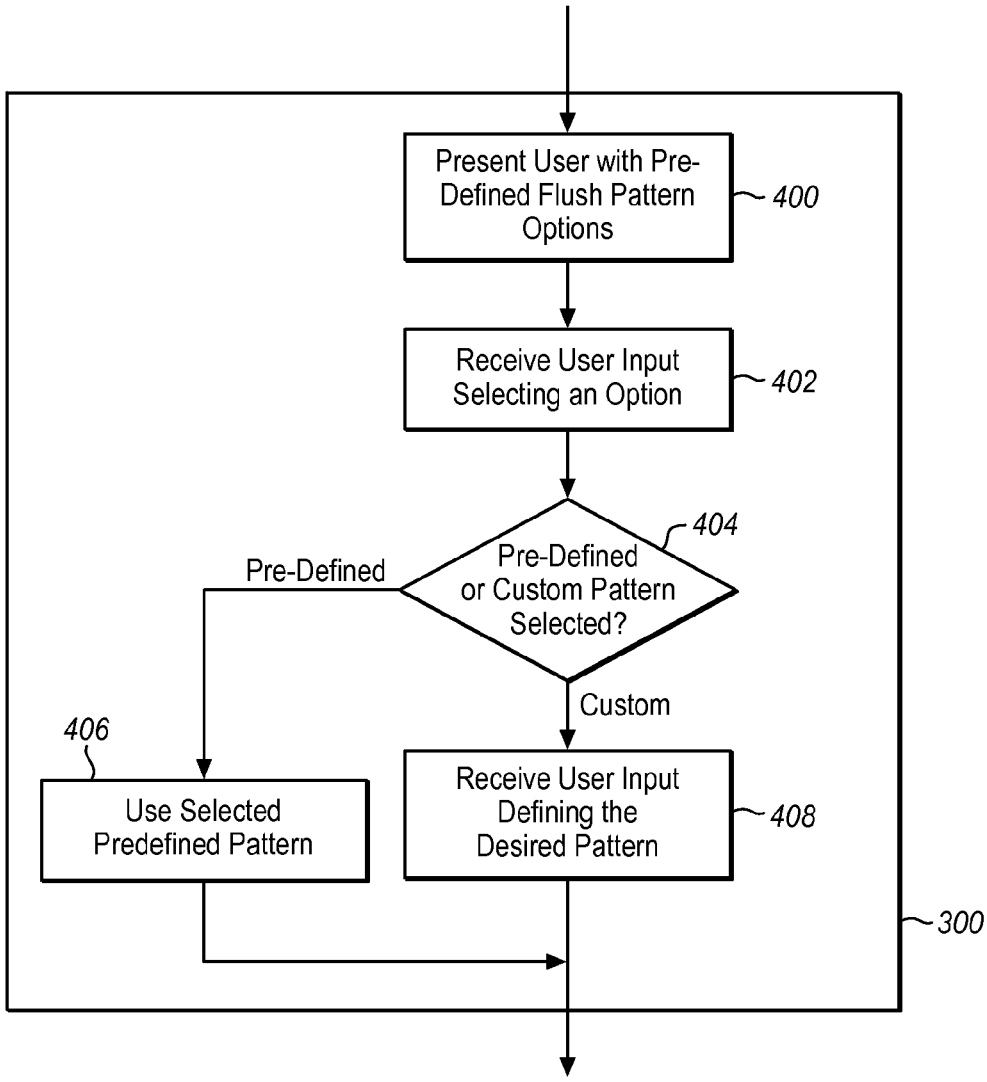
FIGS. 4 through 6 are flowcharts providing exemplary additional details of the processing performed by steps of the method of FIG. 3.

FIG. 4 is a flowchart providing exemplary additional details of the processing of step 300 of FIG. 3 to receive user input defining or selecting a flush pattern. Step 400 first presents a user with one or more predefined flush pattern options. Such a presentation may utilize any suitable text or graphical user interface such as a list of menu items or drop down list. Step 402 then receives the user input selecting one of the provided options. Again, any suitable text or graphical user interface technique and device may be used to receive such user input. In a preferred embodiment, another option may also permit the user to indicate that he or she will provide a fully customized flush pattern. Such a fully customized flush pattern may include, for example, a graphical or image representation that may be useful when added to a sheetside image and/or may be aesthetically acceptable when added to a sheetside image. For example textual information may be generated by a user and appended to a sheetside image for use as a flush pattern. Step 404 therefore determines whether the user input received at step 402 indicates that the user has selected one of the predefined patterns or has indicated a desire to provide a fully customized pattern. If the user selected a predefined pattern, step 406 selects the identified, pre-defined pattern for use as the flush pattern. Otherwise, step 408 receives further user input providing the desired customized flush pattern. Such user input may include, for example, an image file or text sequence to be generated as a flush pattern appended to the sheetside image. Any suitable image or textual data may therefore be provided by a user to define a fully customized flush pattern so long as the pixels generated from the flush pattern served the intended purpose of flushing a desired volume of ink through each of potentially multiple nozzles in the marking engine.

Figure 5:
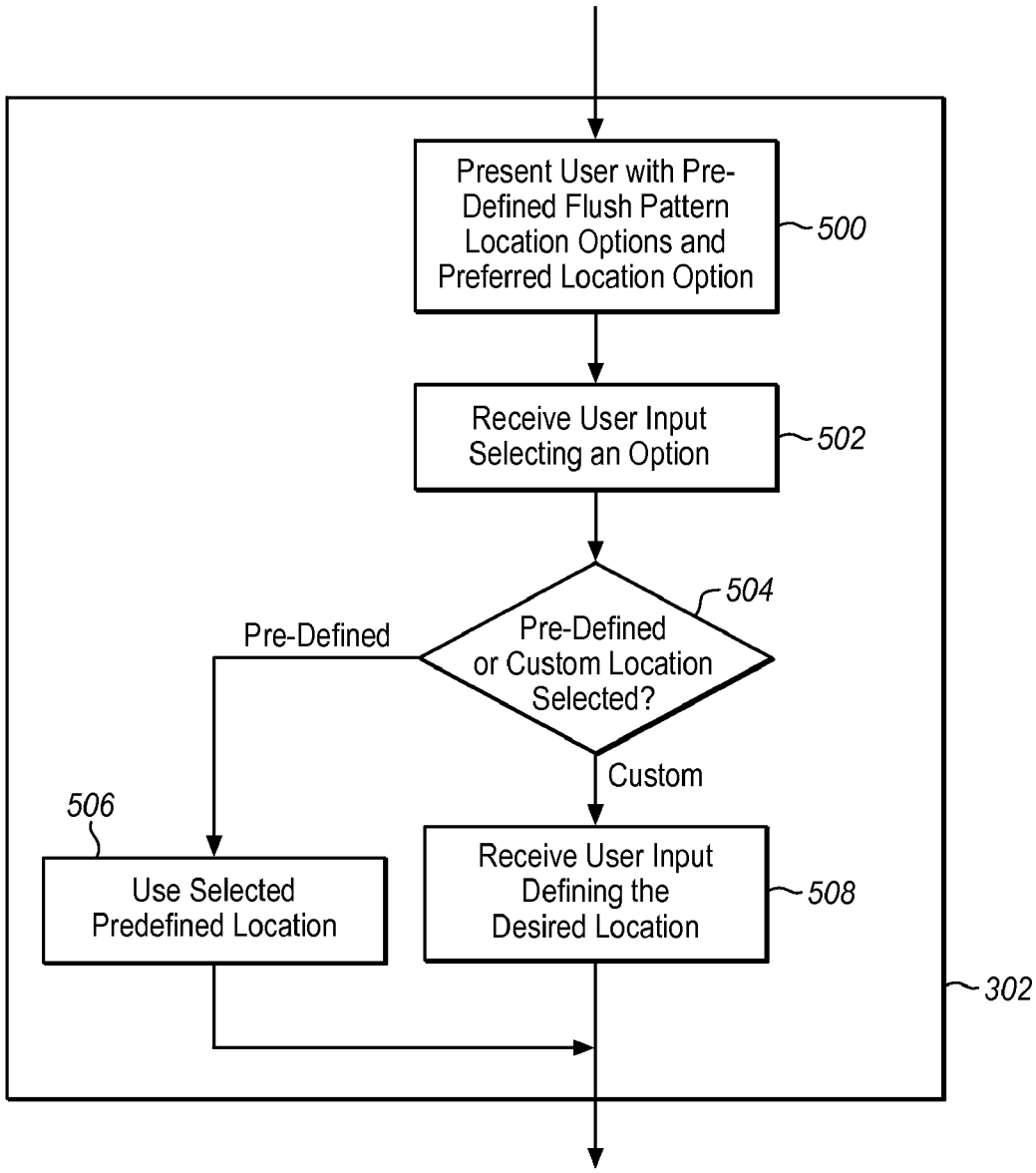

FIG. 5 is a flowchart providing exemplary additional details of the processing of step 302 of FIG. 3 to receive the user input to define or select a location for placement on the sheetside image of the selected the flush pattern. Step 500 presents the user with one or more standardized, pre-defined flush pattern location options. Step 502 then receives further user input selecting one of the various options presented at step 500. As above, the options displayed by step 500 and the user input received by step 502 selecting among the presented options may utilize any suitable text or graphical user input structure and methods. Another option presented for the user is to define a customized location for placement of the selected flush pattern. Step 504 then determines whether the user input at step 502 has selected one of the standardized, predefined locations presented to the user as options. If so, a step 506 utilizes the selected predefined location for placement of the selected flush pattern. If not, step 508 receives further user input defining the desired location for the selected flush pattern. Through further analysis or manual visual analysis by the user a particular location at which he or she desires the flush pattern to be placed may be determined. For example, the one or more sheetside images may be pre-rasterized (as discussed further herein below) and presented to the user on a graphical user interface display. The user may then use the graphical user interface and simply point and click on a location within the displayed, pre-rasterized sheetside images. Further user input may include, for example, a user graphically selecting on the displayed pre-rasterized sheetside images an area in which the user wishes to place the selected flush pattern. Again, any suitable text or graphical user interface technique may be utilized for receiving such user input.

Figure 6:
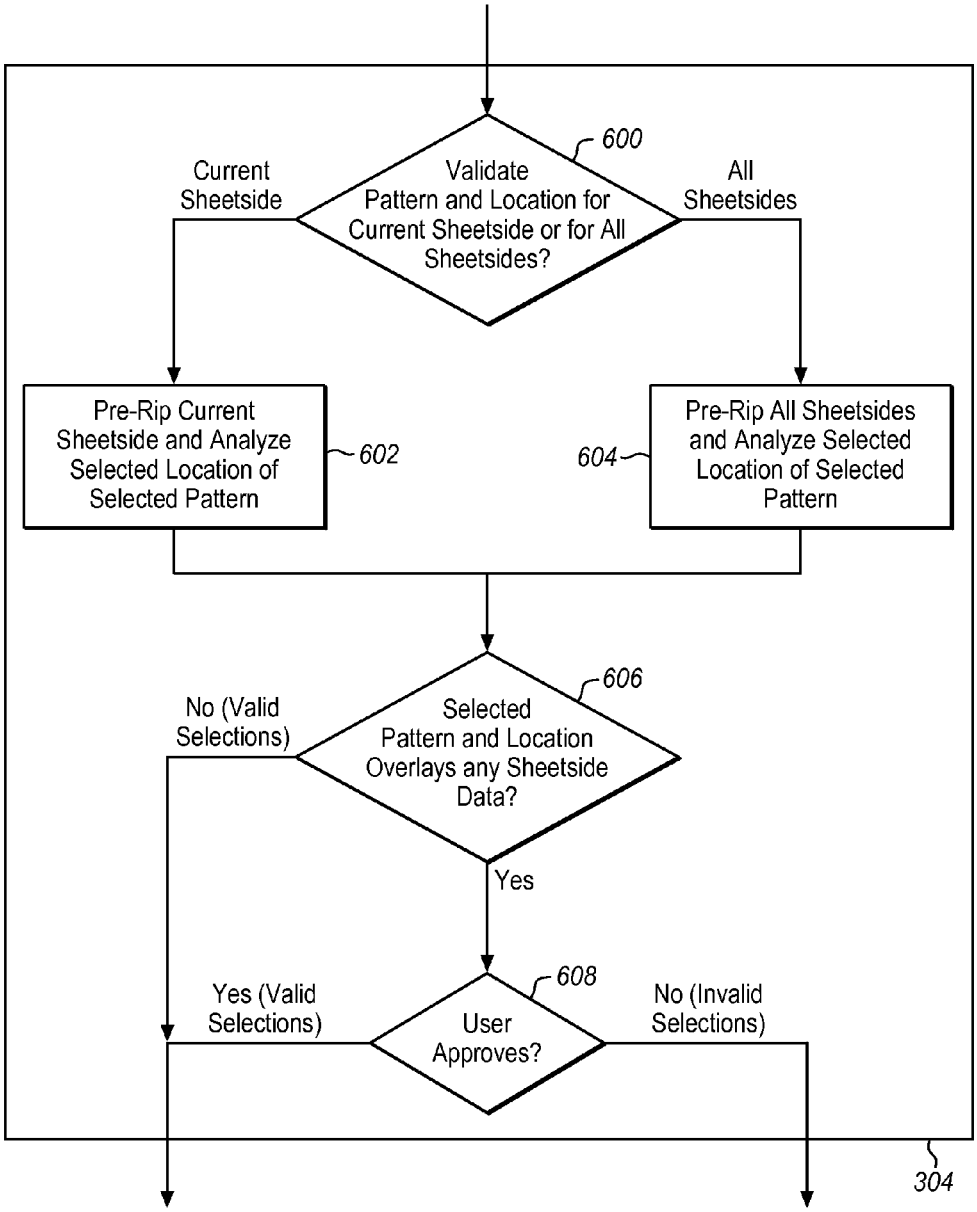

FIG. 6 is a flowchart describing exemplary additional details of the processing of step 304 of FIG. 3 to validate the user selection of a flush pattern and a location for placement of the selected flush. Step 600 first determines whether the validation is to be performed for only a single sheetside (e.g., a current sheetside) or for all sheetsides of a print job sequence of pages. As noted above, the validation analysis may include pre-ripping (e.g., pre-rasterizing) one or more sheetside images to identify portions of the image available for inclusion of an added flush pattern. The pre-rasterized images may be generated at a low resolution and only in monochrome (e.g., grayscale) to speed the computation required for such analysis. Utilizing such pre-rasterized sheetside images, sections of each sheetside that may be blank or may contain very high density, nearly opaque information may be used for flushing ink nozzles. If step 600 determines that only the current sheetside need be analyzed, step 602 pre-rasterizes the current sheetside and analyzes it to identify whether the selected location for placement of the selected pattern overlays or occludes any relevant information on the sheetside image. The analysis entails identifying potentially relevant information based on the presence of text, graphical objects, image data objects, or other objects on the pre-rasterized sheetside. Further, the analysis may entail determining the relative density of the objects—very low and very high density areas may be overlaid with a flush pattern whereas a density that includes textual information would typically not be a good area to overlay the flush pattern. If the pattern overlays relatively dense information, addition of the flush pattern may be aesthetically acceptable and hence valid since it will not likely alter significantly the dense image or graphic object. Conversely, if the flush pattern overlays or occludes text information on the sheetside image the selected location may be deemed invalid. If step 600 determines that the validation analysis should be performed for all sheetside images of a print job (or multiple print jobs), step 604 pre-rasterizes and analyzes all sheetside images provided. Similar analysis determines whether the selected pattern applied at the selected location would interfere with information content of any of the plurality of sheetside images analyzed.

Step 606 determines from the analysis of steps 602 or 604 whether the selected pattern added at the selected location overlays or interferes with any relevant sheetside data. If not, the user's selections of a pattern and a location are considered valid and the valid return from processing of step 304 is performed. Otherwise, step 608 may prompt the user to determine if the user wishes to override the invalidity determination and accept the placement of the pattern as indicated. If so, the valid selection exit from step 304 is performed. Otherwise, the invalid selection exit from step 304 is performed.

Those of ordinary skill in the art will recognize that features and aspects hereof may be applied in ink-based printing system that employ a moving head as well as those employing a fixed head having a array of ink nozzles distributed across the width of the printable medium. Where the print head is movable, it is common to perform such cleaning by moving the head to a position off the edges of the printable medium and to flush ink into a reservoir there. However, features and aspects hereof may none the less be applied to such a moving print head ink-based printing system. In such a case, the flush pattern may be selected accordingly to assure that sufficient ink is flushed through each nozzle as the head moves across the printable medium. In the case of a fixed print head, the selected pattern needs to assure that all nozzles (disposed generally across the width of the printable medium) are flushed at some point in the processing of the printing system. In the case of a fixed printed head, the pattern should be selected such that over a sequence of printed pages, all nozzles are sufficiently flushed.

Where the requirement for printing flush patterns is less than once per sheetside, the custom flush pattern may be constructed with fewer constraints. For example, a textual flush pattern (comprising text information) can provide adequate flushing in some character positions across the sheetside image but not all. The text in the pattern can be shifted left or right each time it is printed, so that the character positions not flushed on one sheetside would get flushed on another. To provide such shifting/rotating of a pattern and assure that at some appropriate interval each nozzle will be sufficiently flushed requires knowledge of some parameters of the printing system.

One parameter associated with determining an optimal flush is the actual flushing requirements of the print engine (e.g., once per every 1000 feet of paper, etc). This parameter is then correlated to the sheetside size to determine how frequently to flush each column (i.e., each nozzle). Scrolling by a single pixel at a time may not achieve good flushing because if the textual message flush pattern contains blanks, the blanks are many pixels wide. If the custom flush pattern text is written in a fixed pitch font, and all non-blank characters occupy the full width of a character position, then the shift distance can be a multiple of the character width. The assumption all non-blank characters occupy the full width is not generally valid because characters such as the period are usually much smaller. But for short messages such as may be used for custom flush pattern text, there may be no punctuation and all glyphs may be the width of a character position. Whether shifting by pixel or by whole characters, the simplest way to ensure adequate flushing for each column is to examine the custom flushing message and determine the largest span of columns that do not flush adequately when printed. That determines the cycle of one-column-at-a-time shifting that will achieve adequate flushing for all columns. If this cycle is within the requirements of the engine, then a simple shift-one-at-time method will work. Another consideration is the sequence of shifted output that is used. The simplest and most obvious is one-position-at-a-time, as on a scrolling message board, with the shift resetting to the start point at the end of the cycle (e.g., rotating the message). When printed page after page, this rotating shift pattern will give the impression of rippling across the page. It would also be possible to print the different shifted messages in a random or pseudorandom order to prevent the rippling impression.

When one-at-a-time shifting is not sufficient to assure adequate flushing, a more sophisticated shifting approach may be used. The need is generally to shift the text message of the flush pattern to positions that hit as many not-yet-flushed columns as possible and don't use shifted positions that hit few or no not-yet-flushed columns. To find the shifted positions that work well can be approached by searching, for instance, using a greedy algorithm as follows:

- Build an array of Boolean values representing whether each column is flushed.
- Pick a starting position and set the Boolean values for all columns based on that starting position.
- Copy the array.
- Count the non-flushed columns.
- Shift the message by one position, set the new Boolean values, and count the non-flushed columns again.
- If there are still non-flushed positions, try again with the next untested shift position. Compare the count of non-flushed columns with the best seen so far and record which shift position is the best.
- Repeat until all shift positions have been tried or a shift position has been found that flushed all columns.
- Then apply the best shift position to the original Boolean array, and repeat the search for the next shift position to be used.

When this search algorithm is complete, a sequence of shifts is determined that flushes all columns with a small number of shifts. If the number of shifts satisfies the machine requirements then this shift pattern may be used. In general, this approach represents the process of searching within a solution space, and many approaches as described in the literature can be applied.

Figure 7:
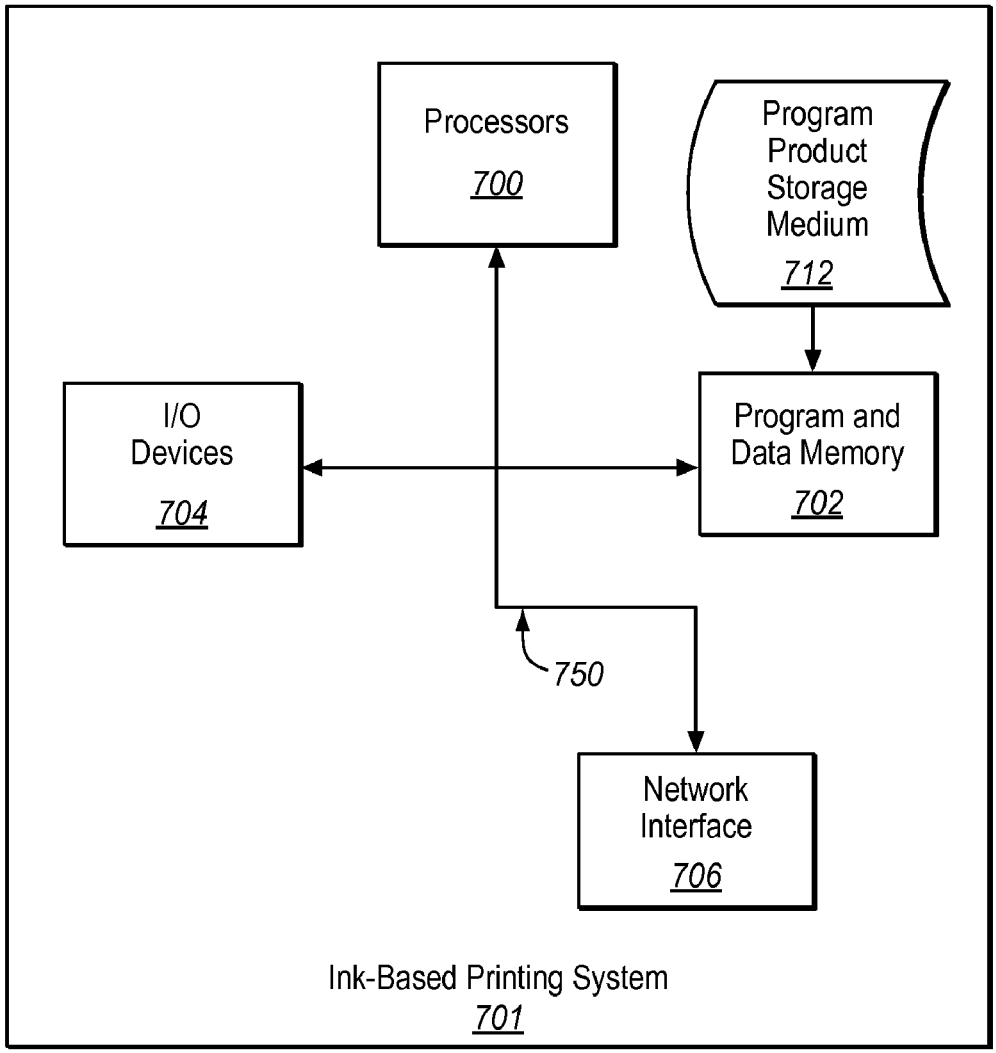
FIG. 7 is a block diagram of a system that can process a computer readable medium containing program instructions implementing methods and processes in accordance with features and aspects hereof.

Embodiments of the invention can take the form of an entirely hardware embodiment, an entirely software embodiment or an embodiment containing both hardware and software elements. In a preferred embodiment, the invention is implemented in software, which includes but is not limited to firmware, resident software, microcode, etc. FIG. 7 is a block diagram depicting an ink-based printing system 701 as a system adapted to provide features and aspects hereof by executing programmed instructions and accessing data stored on a computer readable storage medium 712.

Furthermore, the invention can take the form of a computer program product accessible from a computer-usable or computer-readable medium 712 providing program code for use by or in connection with a computer or any instruction execution system. For the purposes of this description, a computer-usable or computer readable medium can be any apparatus that can contain, store, communicate, propagate, or transport the program for use by or in connection with the instruction execution system, apparatus, or device.

The medium can be an electronic, magnetic, optical, electromagnetic, infrared, or semiconductor system (or apparatus or device) or a propagation medium. Examples of a computer-readable medium include a semiconductor or solid state memory, magnetic tape, a removable computer diskette, a random access memory (RAM), a read-only memory (ROM), a rigid magnetic disk and an optical disk. Current examples of optical disks include compact disk-read only memory (CD-ROM), compact disk-read/write (CD-R/W) and DVD.

A data processing system suitable for storing and/or executing program code will include at least one processor 700 coupled directly or indirectly to memory elements 702 through a system bus 750. As noted above, processors may be distributed among various control elements of a printing system such as in a rasterizing printer controller and a page extractor post-processing element. The memory elements can include local memory employed during actual execution of the program code, bulk storage, and cache memories which provide temporary storage of at least some program code in order to reduce the number of times code must be retrieved from bulk storage during execution.

Input/output or I/O devices 704 (including but not limited to keyboards, displays, pointing devices, etc.) can be coupled to the system either directly or through intervening I/O controllers. Network adapter interfaces 706 may also be coupled to the system to enable the data processing system to become coupled to other data processing systems or storage devices through intervening private or public networks. Modems, cable modems, IBM Channel attachments, SCSI, Fibre Channel, and Ethernet cards are just a few of the currently available types of network or host interface adapters.

Although specific embodiments were described herein, the scope of the invention is not limited to those specific embodiments. The scope of the invention is defined by the following claims and any equivalents thereof.

What is claimed is:

1. A method for managing ink flush operations in an ink-based printing system, the method comprising:

defining, based upon user input, a flush pattern to be applied to a page to print by the printing system;

presenting an option to a user to change a location of the flush pattern from a default location to a user-defined location on the page to print;

selecting, based upon user input, the user-defined location for placement of the flush pattern on the page;

analyzing a sheetside image corresponding with the page to determine if placing the flush pattern at the user-defined location conceals printable content on the sheetside image;

prompting the user to select another user-defined location for placement of the flush pattern on the sheetside image such that the other user-defined location does not conceal printable content on the sheetside image;

adding the defined flush pattern to the sheetside image at the other user-defined location to generate a modified sheetside image; and imprinting the modified sheetside image on a printable medium to thereby flush ink in the printing system by imprinting the selected flush pattern.

2. The method of claim 1 wherein the step of defining the flush pattern further comprises:

selecting the flush pattern from a plurality of pre-defined flush patterns.

3. The method of claim 2 wherein the step of selecting further comprises:

selecting a pre-defined flush pattern from among: a background pattern with overlaid text; a text pattern, an image pattern, a logo pattern, and a barcode pattern.

4. The method of claim 1 wherein the step of selecting the user-defined location further comprises:

selecting from a plurality of pre-defined locations on a sheetside image.

5. The method of claim 4 wherein the step of selecting the user-defined location further comprises:

selecting a pre-defined location from among: a top edge of the sheetside image; a bottom edge of the sheetside image; a right edge of the sheetside image; and a left edge of the sheetside image.

6. The method of claim 1 wherein the step of analyzing the sheetside image further comprises:

pre-rasterizing the sheetside image to generate a monochrome image at a low resolution; and analyzing the monochrome low resolution image to determine if placing the flush pattern at the user-defined location conceals printable content on the sheetside image.

7. The method of claim 1 further comprising:

saving the defined flush pattern and the defined location in a memory, wherein the step of defining the flush pattern further comprises receiving user input indicating a previously saved flush pattern to be retrieved and used as the defined flush pattern, and wherein the step of selecting the user-defined location comprises receiving user input indicating a previously saved location to be retrieved and used as the defined location.

8. A method for flushing ink in an ink-based printing system, the method comprising:

determining a flush pattern to be applied to a plurality of sheetside images in a sequence of printed pages;

presenting an option to a user to change a location of the flush pattern from a default location to a user-defined location on the plurality of sheetside images;

receiving user input specifying the user-defined location at which the flush pattern will be applied to the plurality of sheetside images;

analyzing the plurality of sheetside images for the sequence of printed pages to determine if placing the flush pattern at the user-defined location conceals printable content on the sheetside images;

prompting the user to select another user-defined location for placement of the flush pattern on the sheetside images such that the other user-defined location does not conceal printable content on the sheetside images;

applying the flush pattern to the plurality of sheetside images; and imprinting the sequence of printed pages onto printable media with applied flush patterns to flush ink through one or more ink nozzles of the ink-based printing system.

9. The method of claim 8 further comprising:

shifting the page location of the flush pattern relative to a previous page location prior to application of the flush pattern to each of the plurality of sheetside images, wherein the shifting assures that each ink nozzle of the printing system will be adequately flushed during printing of the sequence of printed pages.

10. The method of claim 9 wherein the step of determining the flush pattern further comprises:

receiving user input defining the flush pattern as a text string.

11. The method of claim 10 wherein the step of determining the flush pattern further comprises:

replicating the text string to fill a width of each of the plurality of sheetside images at the determined page location.

12. The method of claim 9 further comprising:

determining an optimal shift of the flush pattern to assure requisite ink flushing over the sequence of pages wherein the optimal shift is determined based on flushing frequency requirements of the printing system and based on the size of the printable media.

13. Apparatus for flush pattern processing in an ink-based printing system, the system comprising:

a marking engine for imprinting sheetside images as ink on a printable medium;

a printer controller coupled to the marking engine and adapted to generate sheetside images to represent a print job received from an attached source of print jobs and further adapted to apply each sheetside image to the marking engine for imprinting;

a flush pattern generator coupled to the printer controller and adapted to modify a sheetside image generated by the printer controller to add a flush pattern at a user-defined location thereto prior to applying the sheetside image to the marking engine wherein the flush pattern provides informational content when imprinted on printable media; and a user interface module coupled to the flush pattern generator and adapted to define the flush pattern to be added to the sheetside image in response to user interaction, further adapted to present an option to a user to change a location of the flush pattern from a default location to the user-defined location on the sheetside image in response to user interaction, further adapted to analyze the sheetside image to determine if placing the flush pattern at the user-defined location conceals printable content on the sheetside image, further adapted to prompt the user to select another user-defined location for placement of the flush pattern on the sheetside images such that the other user-defined location does not conceal printable content on the sheetside image, and further adapted to select the other user-defined location for placement of the flush pattern on the sheetside image in response to user interaction.

14. The apparatus of claim 13 wherein the flush pattern generator further comprises:

a flush pattern customizer coupled to the user interface and adapted to define a customized flush pattern in response to user input; and a flush pattern location customizer coupled to the user interface and adapted to define a customized location for the flush pattern on the sheetside image in response to user input.

15. A computer readable medium tangibly embodying programmed instruction which, when executed by a computer, perform a method for flushing ink in an ink-based printing system, the method comprising:

determining a flush pattern to be applied to a plurality of sheetside images in a sequence of printed pages;

presenting an option to a user to change a location of the flush pattern from a default location to a user-defined location on the plurality of sheetside images;

receiving user input specifying the user-defined location at which the flush pattern will be applied to the plurality of sheetside images;

analyzing the plurality of sheetside images for the sequence of printed pages to determine if placing the flush pattern at the user-defined location conceals printable content on the sheetside images;

prompting the user to select another user-defined location for placement of the flush pattern on the sheetside images such that the other user-defined location does not conceal printable content on the sheetside images;

applying the flush pattern to the plurality of sheetside images; and imprinting the sequence of printed pages onto printable media with applied flush patterns to flush ink through one or more ink nozzles of the ink-based printing system.

16. The computer readable medium of claim 15 the method further comprising:

shifting the page location of the flush pattern relative to a previous page location prior to application of the flush pattern to each of the plurality of sheetside images, wherein the shifting assures that each ink nozzle of the printing system will be adequately flushed during printing of the sequence of printed pages.

17. The computer readable medium of claim 16 wherein the step of determining the flush pattern further comprises:

receiving user input defining the flush pattern as a text string.

18. The computer readable medium of claim 17 wherein the step of determining the flush pattern further comprises:

replicating the text string to fill a width of each of the plurality of sheetside images at the determined page location.

19. The computer readable medium of claim 16 the method further comprising:

determining an optimal shift of the flush pattern to assure requisite ink flushing over the sequence of pages wherein the optimal shift is determined based on flushing frequency requirements of the printing system and based on the size of the printable media.

* * * * *

UNITED STATES PATENT AND TRADEMARK OFFICE

CERTIFICATE OF CORRECTION

PATENT NO. : 8,262,196 B2
APPLICATION NO. : 11/965464
DATED : September 11, 2012
INVENTOR(S) : Mitchell et al.

It is certified that error appears in the above-identified patent and that said Letters Patent is hereby corrected as shown below:

IN THE SPECIFICATIONS:

In column 2, lines 45-60, the text

"Still another aspect hereof provides apparatus for flush pattern processing in an ink-based printing system. The apparatus includes a marking engine for imprinting sheetside images as ink on a printable medium and a printer controller coupled to the marking engine and adapted to generate sheetside images to represent a print job received from an attached source of print jobs. The printer controller is further adapted to apply each sheetside image to the marking engine for imprinting. A flush pattern generator is also provided and coupled to the printer controller. The flush pattern generator is adapted to modify a sheetside image generated by the printer controller to add a flush pattern thereto prior to applying the sheetside image to the marking engine. The apparatus also includes a user interface module coupled to the flush pattern generator adapted to define the flush pattern to be added to the sheetside"

should read

-- Still another aspect hereof provides apparatus for flush pattern processing in an ink-based printing system. The apparatus includes a marking engine for imprinting sheetside images as ink on a printable medium and a printer controller coupled to the marking engine and adapted to generate sheetside images to represent a print job received from an attached source of print jobs. The printer controller is further adapted to apply each sheetside image to the marking engine for imprinting. A flush pattern generator is also provided and coupled to the printer controller. The flush pattern generator is adapted to modify a sheetside image generated by the printer controller to add a flush pattern thereto prior to applying the sheetside image to the marking engine. The apparatus also includes a user interface module coupled to the flush pattern generator adapted to define the flush pattern to be added to the sheetside image in response to user interaction and adapted to define a location for the flush pattern on the sheetside image in response to user interaction. --.

Signed and Sealed this
Eleventh Day of December, 2012

David J. Kappos

David J. Kappos
*Director of the United States Patent and Trademark Office*